US008717732B2

(12) United States Patent
Stenström et al.

(10) Patent No.: US 8,717,732 B2
(45) Date of Patent: May 6, 2014

(54) HIGH VOLTAGE SURGE ARRESTER

(75) Inventors: Lennart Stenström, Ludvika (SE); Linnea Petersson, Västerås (SE); Xavier Kornmann, Lauchringen (DE); Henrik Hillborg, Västerås (SE)

(73) Assignee: ABB Research Ltd. (CH)

( * ) Notice: Subject to any disclaimer, the term of this patent is extended or adjusted under 35 U.S.C. 154(b) by 0 days.

(21) Appl. No.: 13/487,664

(22) Filed: Jun. 4, 2012

(65) Prior Publication Data

US 2012/0250207 A1 Oct. 4, 2012

Related U.S. Application Data

(63) Continuation of application No. PCT/EP2010/068722, filed on Dec. 2, 2010.

(60) Provisional application No. 61/266,636, filed on Dec. 4, 2009.

(51) Int. Cl.

| | |
|---|---|
| ***H01B 1/20*** | (2006.01) |
| ***H01B 3/30*** | (2006.01) |
| ***H01C 7/12*** | (2006.01) |

(52) U.S. Cl.
USPC ..... 361/118; 361/127; 361/11; 174/137 R

(58) Field of Classification Search
USPC ..... 361/118, 127, 11; 174/137 R
See application file for complete search history.

(56) References Cited

U.S. PATENT DOCUMENTS

| | | | | |
|---|---|---|---|---|
| 4,100,588 | A * | 7/1978 | Kresge | 361/127 |
| 4,335,417 | A | 6/1982 | Sakshaug et al. | |
| 5,602,710 | A * | 2/1997 | Schmidt et al. | 361/127 |
| 6,284,829 | B1 | 9/2001 | Dalbe et al. | |
| 8,160,846 | B2 * | 4/2012 | Yilbas et al. | 703/2 |
| 2005/0256259 | A1 | 11/2005 | Goto et al. | |
| 2008/0030296 | A1 | 2/2008 | Jost et al. | |

FOREIGN PATENT DOCUMENTS

| | | | |
|---|---|---|---|
| CH | 659909 | A5 | 2/1987 |
| EP | 0993238 | A1 | 4/2000 |
| EP | 1067565 | A2 | 1/2001 |
| EP | 1592749 | B1 | 4/2007 |

(Continued)

OTHER PUBLICATIONS

Zhou, et al.; "Effect of Filler Size Distribution on the Mechanical and Physical Properties of Alumina-Filled Silicone Rubber"; Polymer Engineering and Science 2008; pp. 1381-1388.

Zheng, et al.; "Effects of Heat Sinks in Metal-Oxide Surge Arresters on ZnO Element Power Dissipation and Temperature Distribution"; IEEE Trans on Power del., vol. 20, No. 2, pp. 1402-1408, 2005.

(Continued)

*Primary Examiner* — Stephen W Jackson
*Assistant Examiner* — Zeev V Kitov
(74) *Attorney, Agent, or Firm* — St. Onge Steward Johnston & Reens LLC

(57) ABSTRACT

A high voltage surge arrester, including a varistor element arranged so as to be connected to a high voltage source and to carry a high voltage when being positioned in its operative position, and an electric insulator that encloses and is in contact with the varistor element and forms an outer surface of the apparatus, wherein the electric insulator includes a silicone-based rubber. The silicone based rubber includes particles chosen from the group consisting of $Al_2O_3$, BN and ZnO, to such an extent that the thermal conductivity of the silicone-based rubber is equal to or above 0.8 W/mK.

10 Claims, 1 Drawing Sheet

(56) References Cited

FOREIGN PATENT DOCUMENTS

| | | | |
|---|---|---|---|
| EP | 2042558 | A1 | 4/2009 |
| GB | 2040122 | A | 8/1980 |
| JP | 54061253 | A | 5/1979 |
| JP | 5094903 | A | 4/1993 |
| JP | 2002252104 | A | 9/2002 |
| WO | 9723555 | A1 | 7/1997 |
| WO | 2009073901 | A2 | 6/2009 |
| WO | 2009109225 | A1 | 9/2009 |
| WO | 2011067328 | A1 | 6/2011 |

OTHER PUBLICATIONS

International Preliminary Report on Patentability; Application No. PCT/EP2010/068722; Issued: Mar. 16, 2012; 15 pages.

International Search Report & Written Opinion of the International Searching Authority; Application No. PCT/EP2010/068722; Issued: Feb. 11, 2011; Mailing Date: Feb. 21, 2011; 13 pages.

Meyer, et al.; "Thermal Conductivity of Filled Silicone Rubber and its Relationship to Erosion Resistance in the Inclined Plane Test"; IEEE Trans Diel Electr Insul, vol. 11, No. 4, pp. 620-630, 2004.

* cited by examiner

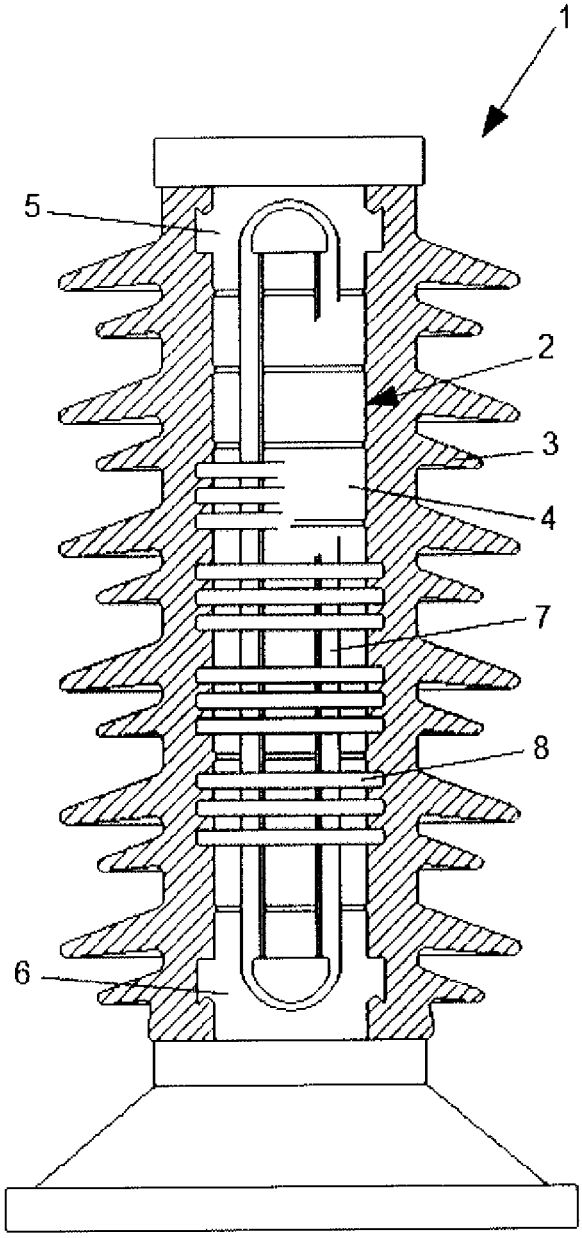
1
5
2
3
4
7
8
6

HIGH VOLTAGE SURGE ARRESTER

CROSS-REFERENCE TO RELATED APPLICATIONS

The present application is a continuation of pending International patent application PCT/EP2010/068722 filed on Dec. 2, 2010 which claims the benefit under 35 U.S.C. §119 (e) of U.S. Provisional Patent Application No. 61/266,636, filed on Dec. 4, 2009. The content of all prior applications is incorporated herein by reference.

FIELD OF THE INVENTION

The present invention relates to a high voltage surge arrester, comprising a varistor element arranged so as to be connected to a high voltage source and to carry a high voltage when being positioned in its operative position, and an electric insulator that encloses said electric component and forms an outer surface of the apparatus, wherein said electric insulator comprises a silicone-based rubber.

Typically the high voltage surge arrester is used outdoor, however it could also be used indoor. The term "outdoor" as used in this context refers to predetermined conditions regarding the existence of dust particles in the environment surrounding the surge arrester, as well as the moisture content in the air surrounding the surge arrester. Values of dust content and air moisture content are those that can be expected in typical outdoor environments. Outdoor conditions may be referred to as pollution severity per pollution classes in IEC 60815.

High voltage, as referred to herein, is defined as voltages of 1 kV and above.

BACKGROUND OF THE INVENTION

High voltage surge arresters are common in the field of electric power transmission and distribution. They may form part of a dissipative system by means of which currents are dissipated upon transient overvoltages occurring in the electric system. Such an arrester may comprise a plurality of varistor blocks, i.e. blocks made of a material that, upon being subjected to a predetermined voltage, turns from a highly resistive state into an electrically conducting state. The arrester may be connected to ground on one hand, and an electric network on the other hand. The varistor blocks need to be electrically insulated and they are insulated as well as protected from the environment by means of an electrically insulating enclosure, thereby forming the surge arrester. Surge arresters of this kind are predominantly located in open air, i.e. in an outdoor atmosphere in which they are subjected to typical outdoor conditions such as deposition of water and dust particles on said enclosure/insulator.

It is a well known fact that such an environment will promote the phenomena of tracking and erosion in the insulator due to leak currents that appear on the surface of the insulator due to deposition of dust and water on said surface. In order to overcome such problems, silicone rubber has been suggested as an outermost electric insulator material, since it has sufficient hydrophobic properties as well as dielectric properties. Silicone rubber also presents mechanical properties that make it suitable as an insulation material.

Apart from the requirements on hydrophobic and dielectric properties, it is also required that the insulator should present sufficient flame retarding properties in the event of an overloading and following short-circuit of the arrester. Therefore, according to prior art, particles of aluminium trihydrate has been mixed into the silicone rubber. Since aluminium trihydrate also has a higher thermal conductivity than the silicone itself, the addition thereof also results in an increase of the thermal conductivity of the silicone rubber. Since the varistor blocks are heated both during normal operation and, in particular, when limiting transient overvoltages, the increase of thermal conductivity obtained as a result of the addition of the aluminium trihydrate is a welcome effect, since it promotes the cooling of the varistor blocks and reduces the risk of overheating thereof. However, the contribution to the increased thermal conductivity of the silicone rubber is still rather restricted, since the thermal conductivity of aluminium trihydrate is not so high. A thermal conductivity above 0.6 W/mK cannot be suspected for this kind of prior art silicone rubber suitable for outdoor insulation applications.

In surge arresters of prior art, the thermal conductivity of the silicone rubber forming the insulator has not been a major problem, since the conductivity conferred by the addition of the aluminium trihydrate and the thermal conductivity of the silicone itself has been sufficient for the transfer of the heat generated by the varistor blocks. However, future surge arresters provided with varistor blocks are conceived to be able of operating with higher electric field strengths than today's surge arresters and will hence emit more heat per unit length than contemporary arresters.

During normal operation only a small current is conducted through the varistor elements but this current increases strongly with both temperature and voltage. Today's arresters are operated continuously at approximately 80% of their rated voltage, this is to some extent due to that the continuous power losses will be too high if the arresters are subjected to a higher continuous operating voltage. If the thermal characteristics of the arresters could be improved also a higher relative continuous operating voltage could be applied which in turn gives a possibility to improve the protection performance of the arrester.

So-called heat sinks (metal blocks of for example aluminium or steel) located between individual varistor blocks are sometimes used in prior art for the purpose of reducing the heat of the varistor blocks. The heat sinks will, however, result in an increase of the length of the surge arrester. This is of disadvantage since it will require the manufacture of longer insulators, which is costly.

SUMMARY OF THE INVENTION

It is an object of the present invention to present a high voltage surge arrester as initially defined, by which the ability of cooling a varistor element and transferring heat from the latter is increased in comparison to corresponding surge arresters of prior art.

It is also an object of the present invention to accomplish the above-mentioned improvement with regard to heat transfer without complicating the design of the electric insulator or having an increased need of space of the surge arrester.

The above mentioned objects of the present invention are achieved by means of a high voltage surge arrester comprising a varistor element arranged so as to be connected to a high voltage source and to carry a high voltage when being positioned in its operative position, the surge arrester further comprising an electric insulator that encloses and is in contact with said varistor element and forms an outer surface of the apparatus, where said electric insulator comprises a silicone-based rubber, and wherein the silicone-based rubber comprises particles chosen from the group consisting of $Al_2O_3$ (Alumina), BN (Boron nitride) and ZnO (Zinc oxide), to such an extent that the thermal conductivity of said silicone-based rubber is equal to or above 0.8 W/mK.

The enhanced thermal conductivity of the insulator will improve cooling of the varistor element and in the case when the varistor element is formed by one or more varistor blocks, the need of so-called heat sinks between such varistor blocks may be reduced. Thereby it is possible to make a more compact surge arrester requiring less space, especially in a length direction of the surge arrester.

In its operative position the surge arrester most commonly is connected between line (power network) and ground, although other connections, such as phase-to-phase also exist. During normal operation only a small current is conducted through the varistor element of the surge arrester, resulting in small amounts of energy being dissipated by the surge arrester at normal operation voltage and normal operation temperature. Upon increase of the voltage to which the varistor element are subjected, the current conducted by the latter will increase and when the voltage reaches a predetermined level a remarkable increase of current as well as amount of energy dissipated by the varistor element will take place. Thereby, the heat generated by the varistor element increases and must be transferred away in order to avoid thermal runaway. Responsible for such heat transfer will be the silicone-based rubber of the electric insulator enclosing the varistor element. The feature that the electric insulator is in contact with the varistor element does not exclude the presence of a primer on the varistor element to assist the adhesion of the silicone-based rubber to the varistor element.

The exact amount of said particles needed in order to obtain the requested thermal conductivity equal to or above 0.8 W/mK will depend on which type or which mixture (fractions of respective type of material) of the above-mentioned particles that is chosen, as well as on average particle size, particle size distribution and particle geometry. However, the person skilled in the art will have no problem in carrying out the invention without any undue burden. Silicone-based rubbers with added $Al_2O_3$, such as those presented in WO9723555, incorporated herein by reference, may be used in order to achieve the requested, enhanced thermal conductivity of the rubber. In accordance with the teaching of said document, and in order to obtain a polyorganic siloxane composition (silicone based rubber) having an enhanced thermal conductivity, that may be even above 1.2 W/mK, and at the same time maintaining an elongation at break of at least 30% it is suggested to use a material comprising at least one functional polyorganic siloxane that hardens through a polyaddition reaction, polycondensation reaction or by way of radicals, possibly a polyorganic hydrogenic siloxane, a catalyzing agent, and at least one powder charge adapted to confer thermal conductibility to the final elastomer, and, possibly, a mechanically strengthening charge, wherein the charge conferring thermal conductivity is present in an amount of 30-75 volume %, preferably 45-65% and even more preferably 50-60% in relation to the volume of the total composition. In particular it is preferred that the particles of this charge comprise at least two groups of different particle sizes, namely a first group with an average particle size of 10-40 μm, preferably 15-35 μm, forming a major part of the charge, and a second group having an average particle size of less than 5 μm, preferably between 0.1 and 5 μm. This group may in its turn be subdivided in two subgroups, a first one with an average particle size of 1-5 μm and a second one with an average particle size of 0.1-0.5 μm. The first subgroup forms 85-90 vol. % of the total of said first and second subgroups. Medium diameter is referred to as when at least 50 weight % of the particles of that group has a diameter within the specified range. A major part is referred to as 60-90% of the particles provided to confer thermal conductivity to the rubber, preferably 75-90 volume % thereof. The powder conferring mechanical strength may be any of those normally used in polyorganic siloxanes, such as silica, in particular combustion silica or precipitation silica. Preferably their average particle size is below 0.5 μm. In order to facilitate the hydrophobic transfer process through pollution layers on the silicone rubber, silicone oil may be added. The oil can be based on polydimethylsiloxane, either methyl or hydroxyl-terminated. These additives may be present up to an amount of approximately 2 weight %.

According to a preferred embodiment, said particles are comprised in the silicone-based rubber to such an extent that the thermal conductivity of said rubber is equal to or above 0.9 W/mK. For thermal conductivities of 0.9 W/mK and above it has also been found that an increased cooling ability is achieved in combination with sheds as a geometric feature of the insulator. For lower values of the thermal conductivity of the insulator material, however, sheds on the insulator do not seem to contribute to any improvement of the cooling ability of the insulator. Hot spots are then formed in the thickest parts of the silicone rubber, under the sheds. This is another thermal constraint in the design of the arrester. Accordingly, that the thermal conductivity of said rubber is equal to or above 0.9 W/mK is a preferred conductivity range, not easily foreseeable for the person skilled in the art.

According to yet a preferred embodiment, a major part of said particles comprises $Al_2O_3$. The latter material has the advantage of being readily available at rather low cost, and also has the advantage of effectively conferring the sought-after flame-retarding property to the silicone rubber, making the addition of aluminium trihydrate for that purpose unnecessary or at least less important. Accordingly, the silicone rubber may, according to one embodiment, comprise less aluminium trihydrate than otherwise deemed necessary in order to achieve a predetermined flame security, or even no aluminium trihydrate at all.

According to another embodiment, said particles are exclusively comprised by $Al_2O_3$. It might also be conceived to fully replace the aluminium trihydrate with the $Al_2O_3$ since it is known that enhancing the thermal conductivity of a silicone rubber will improve the electrical tracking and erosion resistance (Meyer et al, IEEE Trans Diel Electr Insul, Vol. 11, No. 4, pp. 620-630, 2004).

According to one embodiment, said varistor element defines a high field varistor operating at electric field $\geq 200V_{peak}$/mm at its rated voltage. Such high field varistors will most certainly require higher thermal conductivity from the insulator than is offered by today's insulators. This can either be achieved by altering of the geometry of the insulator or by means of an increase of the thermal conductivity of the very material of the insulator body, which is what is suggested by the present invention. The term "high field varistor material" is defined as a material with a predetermined switching field strength (or breakdown field strength). Usually the operating field strength is about 80% of the switching field strength. The switching field strength is a material property and is determined by the grain size of the material or the density of grain boundaries, respectively. Here, the switching field strength is defined as the field strength at a current density of 0.1 mA/cm$^2$. Most of the commercially available varistor materials have switching field strength in the range 150-250 $V_{peak}$/mm. Hence, varistors with such a switching field strength can be designated "normal field varistors" or "medium field varistors". Consequently, varistors with a switching field strength below 150 $V_{peak}$/mm are designated "low field varistors", and varistors with a switching field strength above 250 $V_{peak}$/mm are designated "high field varistors". Thus, the invention, according to this embodiment, relates to such "high field varistors". Furthermore, an additional differentiation between the expression "high field varistor" (switch field strength=250–400 $V_{peak}$/mm) and "extra high field varistor" (switching field strength>400 $V_{peak}$/mm) may be made. The present invention may, accordingly, relate to either a high field varistor or an extra high field varistor.

According to another embodiment, said varistor element comprises a plurality of varistor blocks separated by heat sinks. The heat sinks are formed by disks or blocks made of metal, preferably aluminum-alloys or steel, which rapidly absorbs and removes heat from the varistor blocks. In connection with such heat sinks, the insulator of the invention will cool the varistor blocks very efficiently.

According to another embodiment, the electric insulator formed by the silicone based rubber forms the only layer of solid electric insulator through which heat from the varistor element is to be transferred to the surrounding environment. The feature that the electric insulator formed by the silicone based rubber forms the only layer of solid electric insulator does not exclude the presence of a primer on the varistor element to assist the adhesion of the silicone based rubber to the varistor element.

According to one embodiment the electric insulator has the shape of a casing provided with sheds arranged to increase the tracking and erosion resistance thereof.

According to one embodiment the particles are present in an amount of 25-75 volume %, preferably 30-65 volume %, and even more preferably 30-55 volume % in relation to the volume of the total composition of the silicone based rubber of the electrical insulator. Thereby an electrical insulator with excellent tracking and erosion properties is achieved. Also, the percolation in the silicone based rubber of the electric insulator is optimized with regard to the ratio between the used particle distributions for achieving a thermal conductivity >0.8 W/mK in combination with satisfactory mechanical and electrical properties.

According to one embodiment the particles has a medium diameter of 0.1-100 μm. In an alternative embodiment it is preferred that the particles comprise at least two groups of different particle sizes, wherein a first group has an average particle size of 5-100 μm, preferably 5-40 μm, most preferably 10-30 μm, forming a major part of the particles per volume, and a second group has an average particle size of less than 5 μm, preferably between 0.1 and 5 μm, most preferably 0.1-3 μm.

According to one embodiment the particles are homogenously distributed in the volume of the total composition of the silicone based rubber of the electric insulator. Thereby an optimized thermal conductivity throughout the electric insulator is achieved.

According to one embodiment the silicone-based rubber insulator has been injection-moulded directly onto the varistor element. The varistor element is thereby enclosed in the silicone based rubber such that substantially the whole outer surface of the varistor element is in contact with the silicone-based rubber. Thereby the insulator will cool the varistor element very efficiently. This will also make it possible to make a more compact surge arrester without additional heat sinks arranged between the varistor blocks in the varistor element. The feature that the insulator is in contact with the varistor blocks does not exclude the presence of a primer on the varistor element to assist the adhesion of the silicone-based rubber to the varistor element.

According to one embodiment the specific heat capacity for the silicon based rubber in the electric insulator is equal to, or above, 2.3 J/(K*cm$^3$) at a temperature of 180° C. This enhances the thermal conduction from the varistor element to the electric insulator and the temperature in the varistor element is reduced quickly after a surge event.

Further features and advantages of the present invention will be presented in the following detailed description and in the enclosed patent claims.

BRIEF DESCRIPTION OF THE DRAWINGS

Hereinafter, a preferred embodiment of a high voltage surge arrester will be described more in detail by way of example with reference to the drawing, in which:

FIG. 1 is a partly cross-sectioned side view of a high voltage surge arrester according to the invention.

DETAILED DESCRIPTION OF THE INVENTION

A high voltage surge arrester 1 according to one embodiment of the invention is shown in FIG. 1. The surge arrester 1 comprises a varistor element 2 and an insulator 3 enclosing the varistor element 2. The insulator 3 is formed by a single shell or layer of a silicone-based rubber that has been injection moulded onto the varistor element 2. Accordingly, the silicone-based rubber insulator 3 is applied directly onto the varistor element 2 and also forms an outer surface of the apparatus facing the surrounding environment.

The varistor element 2 comprises a stack of varistor blocks 4. The varistor blocks 4 are made of a material that is highly electrically resistive up to a certain voltage level, above which it turns into an electrically conducting state. Such a material may, for example, comprise ZnO, but there are lots of alternative materials that will be obvious for a person skilled in the art.

The varistor blocks 4 extend between two end flanges 5, 6. Between the varistor blocks 4 and the insulator 3, embedded in the latter, and attached in opposite ends to the flanges 5, 6 the apparatus 1 comprises holders 7 formed by strings of fibre reinforced resin. The holders 7 serve to hold the stack of varistor blocks in place between the above-mentioned flanges 5, 6. Wound around the holders are security members 8, also formed by a fibre reinforced resin, that serve to secure the varistor blocks and the holders 7 in case of a failure of the apparatus and prevent the whole device from bursting. In FIG. 1 the security members 8 have been shown only along a part of the length of the stack of varistor blocks 4. However, it should be understood that, normally, they will be provide along the whole length of said stack. These are design features known per se through prior art.

During manufacture of the surge arrester 1, the stack of varistor blocks 4 is placed between the flanges 5, 6 and locked to the latter by means of the holders 7. Subsequently, the security members 8 are wound around the holders 7. After that the component produced so far is placed in mould and the silicone-based rubber is injection moulded onto the body thereof, thereby getting into direct contact with the varistor blocks 4 and embedding the holders 7 and the security members 8. A primer may be needed to ensure good adhesion between the silicone rubber and the internal parts of the arrester.

The insulator 3 comprises sheds that prolong the surface thereof in the longitudinal direction of the apparatus, for the purpose of limiting leakage currents on the surface and preventing risk of flashover under polluted conditions and heavy rain and upcoming of tracking and erosion caused by leakage currents on said surface. This kind of geometry is since long time established as preferred for insulators for outdoor use, by which the latter are subjected to dust and moisture that will promote the upcoming of such tracking and erosion.

The insulator 3 is homogenous, i.e. it has the same material characteristics throughout its thickness. It comprises a silicone-based rubber matrix into which there is mixed a predetermined percentage of particles comprising a material from the group consisting of $Al_2O_3$, BN, ZnO, or a mixture thereof. To achieve the same material characteristics throughout the thickness of the insulator the particles are homogenously distributed in the silicone-based rubber. This homogenous distribution is achieved at the manufacturing of the material and the person skilled in the art will have no problem of carrying out the blending of the silicone-based rubber and the particles to achieve a homogenous distribution of the particles. The predetermined amount of said particles is high enough to confer a thermal conductivity of 0.8 W/mK of the resulting silicone-based rubber. Preferably, $Al_2O_3$ is exclusively used for the purpose of conferring such enhanced thermal conductivity to the rubber.

What is claimed is:

1. A high voltage surge arrester, comprising a varistor element arranged so as to be connected to a high voltage source and to carry a high voltage when being positioned in its operative position, and an electric insulator that encloses and is in contact with said varistor element and forms an outermost surface of the high voltage surge arrester, wherein said electric insulator consists of a silicone-based rubber, characterised in that the silicone based rubber comprises particles chosen from the group consisting of $Al_2O_3$, BN and ZnO, to such an extent that the thermal conductivity of said silicone-based rubber is equal to or above 0.8 W/mK, in that the particles are present in an amount of 25-75 volume % in relation to the volume of the total composition of the silicone based rubber of the electrical insulator, and in that the particles have an average particle size of 0.1-100 μm.

2. The high voltage surge arrester according to claim 1, wherein a major part of said particles comprises $Al_2O_3$.

3. The high voltage surge arrester according to claim 1, wherein said particles are exclusively comprised by $Al_2O_3$.

4. The high voltage surge arrester according to claim 1, wherein said electric insulator has the shape of a casing provided with sheds arranged to increase the tracking and erosion resistance thereof.

5. The high voltage surge arrester according to claim 1, wherein the particles are homogenously distributed in the volume of the total composition of the silicone based rubber of the electrical insulator.

6. The high voltage surge arrester according to claim 1, wherein the insulator formed by the silicone based rubber forms the only layer of solid electric insulator through which heat from the varistor element is to be transferred to the surrounding environment.

7. The high voltage surge arrester according to claim 1, wherein the silicone-based rubber insulator has been injection-moulded directly onto the varistor element.

8. The high voltage surge arrester according to claim 1, wherein the specific heat capacity for the silicon based rubber is equal to, or above, 2.3 J/(K*cm$^3$) at a temperature of 180° C.

9. A high voltage surge arrester, comprising:

a varistor element arranged so as to be connected to a high voltage source and to carry a high voltage when being positioned in its operative position, and an electric insulator that encloses and is in contact with said varistor element and forms an outer surface of the high voltage surge arrester, wherein said electric insulator consists of a silicone-based rubber, characterised in that the silicone based rubber comprises particles chosen from the group consisting of $Al_2O_3$, BN and ZnO, to such an extent that the thermal conductivity of said silicone-based rubber is equal to or above 0.8 W/mK, in that the particles are present in an amount of 25-75 volume % in relation to the volume of the total composition of the silicone based rubber of the electrical insulator, and in that the particles have an average particle size of 0.1-100 μm, wherein said electric insulator has the shape of a casing provided with sheds arranged to increase the tracking and erosion resistance thereof.

10. A high voltage surge arrester, comprising:

a varistor element arranged so as to be connected to a high voltage source and to carry a high voltage when being positioned in its operative position, and an electric insulator that encloses and is in contact with said varistor element and forms an outer surface of the high voltage surge arrester, wherein said electric insulator consists of a silicone-based rubber, characterised in that the silicone based rubber comprises particles chosen from the group consisting of $Al_2O_3$, BN and ZnO, to such an extent that the thermal conductivity of said silicone-based rubber is equal to or above 0.8 W/mK, in that the particles are present in an amount of 25-75 volume % in relation to the volume of the total composition of the silicone based rubber of the electrical insulator, and in that the particles have an average particle size of 0.1-100 μm, wherein the insulator formed by the silicone based rubber forms the only layer of solid electric insulator through which heat from the varistor element is to be transferred to the surrounding environment.

* * * * *